United States Patent [19]

Finnegan

[11] 4,391,376

[45] Jul. 5, 1983

[54] RESILIENT CLAMP FOR SUPPORTING ARTICLES

[75] Inventor: Charles C. Finnegan, Escondido, Calif.

[73] Assignee: LeLasso Corporation, San Diego, Calif.

[21] Appl. No.: 216,620

[22] Filed: Dec. 15, 1980

[51] Int. Cl.[3] ..... A47F 7/00; E21B 19/14

[52] U.S. Cl. ..... 211/60 SK; 29/451; 29/453; 29/526 R; 248/73; 248/221.4

[58] Field of Search ..... 29/451, 453, 526 R; 211/60 SK; 248/73, 74.3, 74.5, 74.1, 74.2, 74.4, 221.4, 221.3, 544

[56] References Cited

U.S. PATENT DOCUMENTS

| | | | |
|---|---|---|---|
| 2,653,686 | 9/1953 | Routt | 29/453 X |
| 3,154,281 | 10/1964 | Frank | 248/74.3 X |
| 3,253,084 | 5/1966 | Taylor | 248/74.3 X |
| 3,632,071 | 1/1972 | Cameron | 248/74.5 |
| 3,807,675 | 4/1974 | Seckerson | 248/73 |
| 3,809,799 | 5/1974 | Taylor | 248/221.4 X |
| 3,894,706 | 7/1975 | Mizusawa | 248/73 |
| 3,913,876 | 10/1975 | McSherry | 248/73 X |
| 3,917,202 | 11/1975 | Reinwall, Jr. et al. | 248/73 X |
| 3,985,275 | 10/1976 | Allen | 211/60 SK X |
| 4,023,758 | 5/1977 | Yuda | 248/74.5 X |

FOREIGN PATENT DOCUMENTS

| | | | |
|---|---|---|---|
| EP3195 | 7/1979 | European Pat. Off. | 211/60 SK |

*Primary Examiner*—Charlie T. Moon
*Attorney, Agent, or Firm*—Brown & Martin

[57] ABSTRACT

A clamp member is assembled onto a mounting base by compression of the resilient material of the clamp member. When allowed to expand the clamp member engages the mounting base to securely hold the clamp member into position. Articles to be supported are received between opposed clamp elements and retained in position between the clamp elements by an elastic cord with a hook and loop attachment device. The hook member includes means for clamping the end of the elastic cord. This portion of the hook member is received within the channel so that only the hook section itself extends beyond the clamp member. With a rigid article locked in place on the clamp member, it is no longer possible to compress the clamp member with hand pressure so that the clamp member is rigidly secured to the mounting base.

8 Claims, 4 Drawing Figures

RESILIENT CLAMP FOR SUPPORTING ARTICLES

BACKGROUND OF THE INVENTION

Numerous bulky, heavy and unwieldy articles must be stored in and carried to and from the modern home. Many of the articles may not be stored safely without a device to insure that they will not inadvertently fall against persons or against other stored articles. Downhill and cross country skis are especially difficult to safely store in a manner that protects the skis against damage and against falling damaging other articles in a manner that minimizes the use of storage space. Skis that are strapped together may be mounted against a vertical wall by a pair of spaced pegs supporting the skis from their tips. However, there is no ready way of mounting such pegs directly to a house wall, particularly where dry wall construction is utilized. Accordingly, a separate wooden backboard must be utilized to carry the pegs. Such assemblies are relatively expensive to produce and difficult to install. In addition, they may damage the skis by causing the skis to take a set when spaced parts of the opposed skis are held together for long periods of time.

A variety of car top carriers are provided for skis. However, car top carriers have not been adapted to use as a storage clamp for supporting the skis against a wall. One particular prior art carrier utilizes a plurality of plastic blocks to support skis on a car roof. A strap of webbing material carries a plurality of the blocks and two sets of blocks fore and aft are utilized to provide complete support. However, no provision is made with this prior art carrier for utilizing the plastic blocks as a support structure for supporting the skis on a vertical surface. Thus, even though the plastic blocks and webbing material are relatively light in weight and otherwise desirable, they still do not solve the problem of long term storage of the skis in a residence.

It is therefore desirable to have a support for releasably mounting skis and other heavy, bulky, or unwieldy articles against a wall or other support structure, such clamp is particularly desirable where the clamping member may be easily installed on and removed from the supporting structure.

SUMMARY OF THE INVENTION

In an exemplary embodiment of the invention, the unanswered need for a satisfactory clamp that will support skis and other articles is answered by a resilient clamping member which may be easily mounted on and removed from a mounting base. The base incorporates a pair of spaced inwardly directed opposed projections. The clamping member incorporates a mounting section of resilient material which can be compressed by hand to pass between the opposed projections. When the resilient mounting section is released, it expands and is engaged by the projections. Skis or other articles are releasably mounted on the clamping member. Since skis are relatively rigid and cannot be compressed by hand, once the skis are in place on the device it is no longer possible to compress the resilient mounting section sufficient to disengage the clamping member from the opposed projections. Thus, the mounting of the skis serves both to hold the skis in position on the clamp and at the same time to hold the clamp in engagement with the projections.

In a specific form of the invention, the skis are clamped between elongated opposed clamping elements which are urged together to hold the skis in a channel-like opening through the clamp member. An elongated extensible member may be utilized to urge the clamping members into engagement with skis and also to encircle the skis to securely hold them in position. The use of an elastic cord is preferred and according to the invention a specific form of end connector for the cord is utilized which is especially advantageous when utilized with the invention. The hook member clamps over the doubled back ends of the elastic cord and forms a terminal cross-sectional size not substantially greater than the size of the two parallel courses of the cord themselves. Accordingly, the cord in clamping section of the hook can be received in a channel through the clamping member. Thus, only the hook section of the hook member protrudes from the clamping member for being engaged with the loop on the opposite ends of the double elastic cord.

The resulting bracket is easily mounted on a vertical wall or other supporting structure, either horizontal or vertical, because of the resilient mounting function. The clamp is light in weight and will not mar delicate finishes or damage easily breakable articles. The clamp member may be molded out of relatively inexpensive materials and still provide a high quality and durable supporting clamp. The clamped articles are held securely in place by an elastic cord which does not protrude substantially from the clamp member and therefore is less likely to interfere with adjacent articles or to mar the surface of the clamped articles. When skis are mounted in the clamp member they may be clamped together at the point where the two opposed skis naturally touch one another. Accordingly, there is no compression of the skis and therefore no danger of deforming the skis by long storage.

Many attendant advantages of the invention will become more apparent upon reading of the following detailed description, together with the drawings in which like referenced numerals refer to like parts throughout and in which:

DETAILED DESCRIPTION OF THE DRAWINGS

Figure 4:
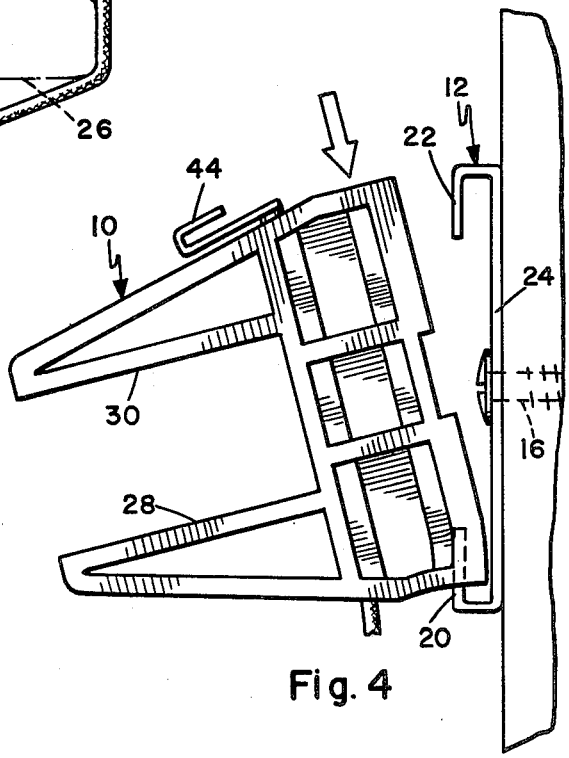
FIG. 4 is a side elevation view showing the method of attaching the clamp member to its mounting base.

Referring now to the drawings, there is illustrated a clamp member 10 according to the invention. The clamp member is mated with a mounting base 12. The mounting base 12 is fixedly secured to the wall section 14 by a suitable fastener such as screw 16. For maximum security of the clamp member 10 on the mounting bracket, a channel 18, elongated in the plane of the mounting base 12, extends across the entire length of the clamp member 10. In order to assemble the clamp member to the base 12 as is illustrated in FIG. 4, the clamp member is inserted at an angle over the first projection 20 on base 12, and then is compressed by pressure with the palm of the hand immediately adjacent to the opening of channel 18. Because of its construction of resilient material, such as polyvinyl plastic, and because of the relieved construction of the clamping member, it is possible to compress the clamping members sufficiently for the opposite end of the clamping member to clear the second projection 22 on base 12 and then to be lowered into alignment with the central mounting section 24 of base 12. When in alignment with the central mounting section 24, the compressive force is released and the clamping member 10 then expands so that the second projection 22 enters the channel 18 releasably securing the clamping member 10 on the mounting base 12.

After installing the clamping member on the base, it is then possible to insert a pair of skis 26 or other similar article to be clamped and supported. The skis are received between the extended clamp elements 28 and 30. Depending upon the size of the article to be clamped, and the spacing selected for the opposed clamping elements 28 and 30, the mere resilient force of the clamp members against the article to be clamped may be sufficient to hold it in position. When in position on the clamping member 10, the article has the effect of preventing compression of the clamping member and accordingly it is not possible to dislodge the clamping member from the mounting base. Thus, the resiliency of the clamping member is utilized, on the one hand, to make it easily mountable to a mounting base 12, and at the same time the resiliency is utilized to grasp the article 26. However, once a rigid article is received on the clamping member, it is no longer possible to compress, and therefore the resiliency does not work against the security of the completed assembly. In most instances it is desirable to complete the security of the system by a supplemental means for urging the clamping elements 28 and 30 into engagement with the skis 26. An especially adapted elongated extensible resilient member 32 is utilized for this purpose. An elastic cord is doubled upon itself to form parallel courses 34 and 36 which are received through a channel 38 parallel to channel 18 but spaced therefrom. The free ends of the resilient member 32 are clamped together and to a hook member by a pair of deformable straps 40 and 42. The cross sectional diameter of the clamped terminus of the resilient member 32 is not significantly larger than the cross sectional diameter of the two parallel courses 34 and 36 themselves. Accordingly it is possible to insert the clamped straps 40 and 42 into the channel 38 so that only the hook portion 44 protrudes. The hook portion 44 is configured to lie along the surface of the clamp element 30 and to therefore not significantly extend beyond the confines of the clamp member 10. At the opposite end of the extensible member 32, a ring 46 has been secured by looping the elastic cord over the ring in a well known manner. The elastic cord may then be stretched over the clamped article 26 and received onto the hook portion 44 of the hook member to fully secure the article to the clamp member 10 and to further insure the integrity of the connection between the clamp member and mounting base.

Figure 1:
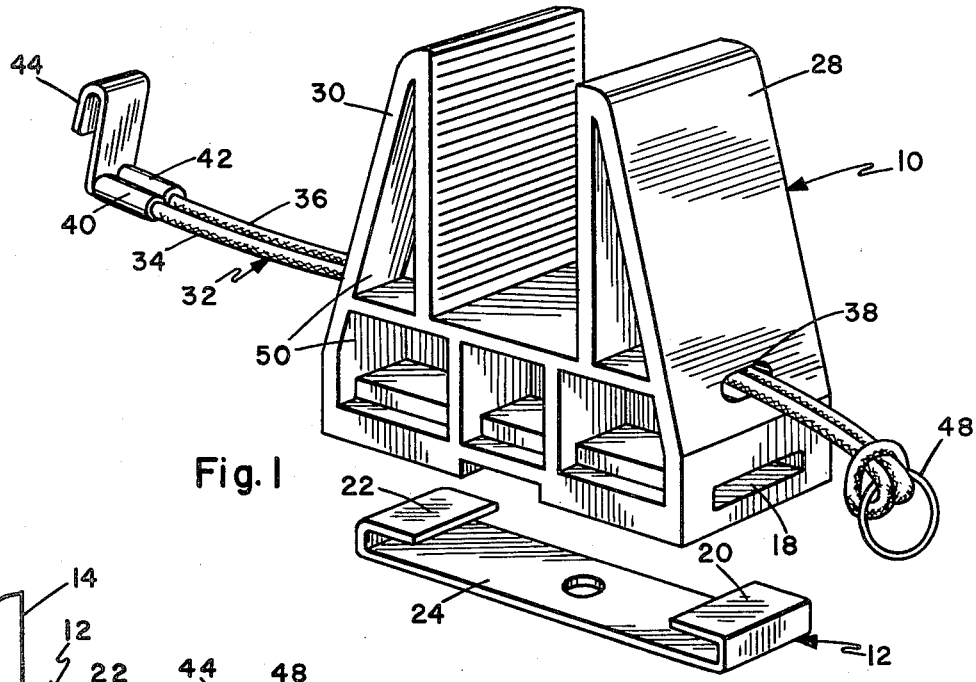
FIG. 1 is a perspective view of the complete clamp member.
Figure 2:
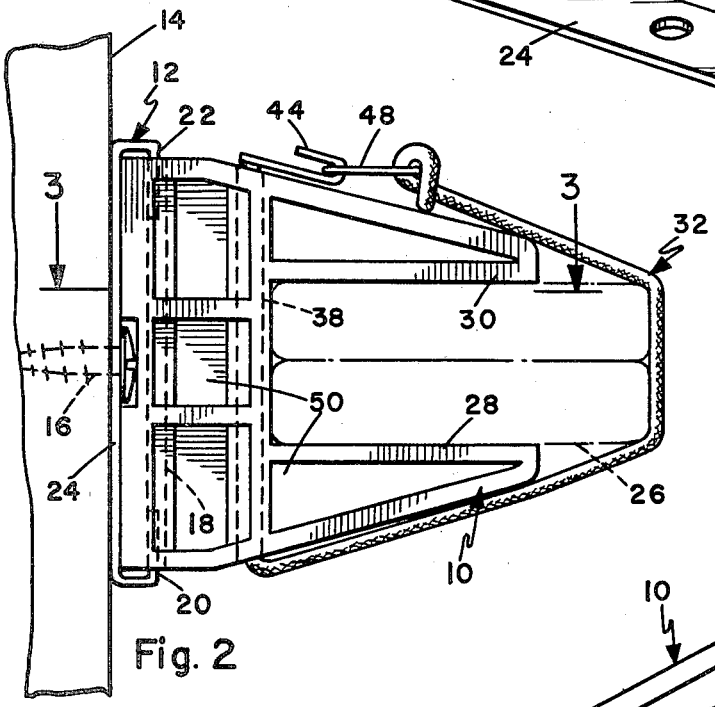
FIG. 2 is a side elevation view of the clamp member attached to a supporting surface.
Figure 3:
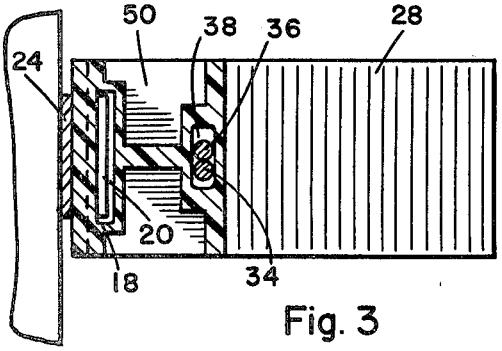
FIG. 3 is a sectional view taken on line 3—3 of FIG. 2.

Referring now particularly to FIG. 2, the specific configuration of the clamp member is illustrated. It will be noted that a plurality of lightening openings 50 are provided both to reduce the materials cost and weight, while at the same time increasing the compressability and therefore the ease with which the clamp member may be compressed for insertion onto the mounting base. A similar structure is found in prior art ski top carriers, but the utility of such structures in combination with a mounting base such as mounting base 12 had not been recognized in prior art structures.

Having described my invention, I now claim:

1. Apparatus for clampably supporting articles, comprising:

a mounting base for being secured to a supporting structure incorporating a pair spaced inwardly directed opposed projections, said mounting base comprising a strap member, having a flat central mounting section and end sections that are spaced from said central mounting section and comprising in their terminal portions said opposed projections;

a clamping member for removable mounting on said mounting base, said clamping member comprising a resilient mounting section incorporating opposed outwardly directed openings sized to receive said projections, said outwardly opposed openings comprising a channel through said mounting section, said channel being elongated in a plane that is parallel, in the mounted position, to the plane of said central mounting section;

said resilient mounting section being compressible to a length permitting said section to pass between said opposed projections and expandable to engage said opposed projections, a pair of opposed clamping elements extending from said mounting section for receiving an article therebetween, an elastic cord having end connectors for encircling said clamping elements and an article received between said clamping elements to resiliently urge said clamping members toward one another, said elastic cord being received through the channel in said mounting section, said end connectors comprising a hook member, said hook member comprising at least one deformable clamping strap means for being compressed onto an end of said cord, and having a hook section extending from said strap clamping means;

said cord and strap clamping means being receivable in said channel in said mounting section, said hook section having a cross section larger than said channel and protruding therefrom when said cord and strap are received in said channel.

2. Apparatus for clampably supporting articles according to claim 1, wherein:

said hook section being adapted to lie along the outer wall of said clamp member.

3. Apparatus for clampably supporting articles comprising: a mounting base for being removably secured to supporting structure incorporating a pair of spaced inwardly directed opposed projections, clamping means for removably mounting on said mounting base and incorporating opposed outwardly directed openings sized to receive said projections when said clamping means is resiliently compressed to pass between said opposed projections and expanded to engage said projections in said outwardly directed openings, said clamping means comprising a pair of opposed clamping elements and means for resiliently urging said clamping elements toward one another, said means for resiliently urging said clamping elements toward one another comprising an elongated extensible means having engageable end connectors for encircling said clamping elements and an article received between said clamping elements, said extensible means comprising an elastic cord, a channel in said mounting section, said channel receiving said elastic cord, said end connectors comprising a loop member and a hook member, said hook member comprising at least one deformable, clamping strap means for being compressed over onto and retaining an end of said cord and having a hook section extending from said clamping strap means.

4. Apparatus for clampably supporting articles according to claim 3, wherein:

said hook section being adapted to lie along the outer wall of said clamp member.

5. Apparatus for clampably supporting articles according to claim 3, wherein:

said elongated extensible means comprises a length of elastic cord received through said ring member and being doubled over to run in two parallel courses through said channel, said hook member incorporating a pair of deformable, cord-clamping straps compressed onto and retaining both ends of said cord.

6. Apparatus for clampably supporting articles comprising:

a mounting base for being secured to supporting structure incorporating a pair of spaced inwardly directed opposed projections, a clamping member for removable mounting on said mounting base, said clamping member comprising a resilient mounting section and a pair of opposed resilient clamping elements extending from said mounting section for receiving said articles therebetween, said mounting section incorporating opposed outwardly directed openings sized to receive said projections, means for resiliently urging said clamping elements toward one another, said mounting section being compressible to a length permitting said section to pass between said opposed projections and expandable to engage said opposed projections in said outwardly directed openings.

7. Apparatus for clampably supporting articles according to claim 6, wherein:

said means for resiliently urging said clamping elements toward one another comprises an elongated extensible means attachable to said clamping member, and having end connectors for encircling said clamping elements and articles received between said elements.

8. An apparatus for clampably supporting articles according to claim 7, wherein:

said extensible means comprises an elastic cord being received through a channel in said mounting section, said end connectors comprising a hook member, said hook member comprising at least one deformable cord clamping strap means for being compressed onto an end of said cord and having a hook section extending from said strap clamping means being receivable in said channel in said mounting section, said hook section having a cross section larger than said channel and protruding therefrom when said cord and strap are received in said channel, and said hook section being adapted to lie along the outer wall of said clamp member.

* * * * *